US011332944B2

(12) United States Patent
Boyd et al.

(10) Patent No.: US 11,332,944 B2
(45) Date of Patent: May 17, 2022

(54) TILE ALTERNATIVE MATERIAL

(71) Applicant: Aleris, LLC, Lancaster, SC (US)

(72) Inventors: William Boyd, Charleston, SC (US); Nicholas Godfrey, Charleston, SC (US); David Ober, Fort Mill, SC (US); Calvin Trumbo, Waxhaw, NC (US)

(73) Assignee: Aleris, LLC, Lancaster, SC (US)

( * ) Notice: Subject to any disclaimer, the term of this patent is extended or adjusted under 35 U.S.C. 154(b) by 0 days.

(21) Appl. No.: 16/282,804

(22) Filed: Feb. 22, 2019

(65) Prior Publication Data

US 2019/0271162 A1 Sep. 5, 2019

Related U.S. Application Data

(60) Provisional application No. 62/637,608, filed on Mar. 2, 2018.

(51) Int. Cl.

| | |
|---|---|
| ***E04F 13/00*** | (2006.01) |
| ***E04F 15/00*** | (2006.01) |
| ***E04B 1/00*** | (2006.01) |
| ***E04F 13/08*** | (2006.01) |
| ***E04F 13/12*** | (2006.01) |
| ***E04F 15/06*** | (2006.01) |
| ***E04B 1/94*** | (2006.01) |
| ***E04F 15/02*** | (2006.01) |
| ***E04B 1/66*** | (2006.01) |

(52) U.S. Cl.

CPC ..... *E04F 13/0885* (2013.01); *E04B 1/665* (2013.01); *E04B 1/942* (2013.01); *E04F 13/12* (2013.01); *E04F 15/0215* (2013.01); *E04F 15/06* (2013.01)

(58) Field of Classification Search

CPC ..... E04F 13/00; E04F 13/08; E04F 13/088; E04F 13/0885; E04F 13/10; E04F 13/12; E04F 15/00; E04F 15/02; E04F 15/021; E04F 15/0215; E04F 15/06; E04B 1/00; E04B 1/60; E04B 1/66; E04B 1/665; E04B 1/90; E04B 1/94; E04B 1/942

See application file for complete search history.

(56) References Cited

U.S. PATENT DOCUMENTS

| | | | | |
|---|---|---|---|---|
| 5,937,612 A * | 8/1999 | Winer | B44C 5/0438 52/747.11 |
| 9,297,167 B1 * | 3/2016 | Stockton | E04C 2/40 |
| 2004/0126602 A1 * | 7/2004 | Wallner | E04F 13/141 428/500 |

* cited by examiner

*Primary Examiner* — Jacob T Minskey
*Assistant Examiner* — Matthew Hoover

(57) ABSTRACT

Methods and associated apparatuses are described herein that provide a tile alternative material. The tile alternative material may be manufactured by providing a substrate that defines a first surface, and a second surface opposite the first surface. The second surface is configured to be secure, via an adhesive or otherwise, to a support surface. The method further includes coating an exterior layer on the first surface of the substrate, and forming a pattern element in the first surface of the substrate. Forming the pattern element includes removing material from the substrate and the coated exterior layer of the first surface to form one or more recessed portions.

18 Claims, 6 Drawing Sheets

TILE ALTERNATIVE MATERIAL

CROSS-REFERENCE TO RELATED APPLICATIONS

This application claims the benefit of U.S. Provisional Application No. 62/637,608, filed Mar. 2, 2018, which is hereby incorporated by reference.

TECHNOLOGICAL FIELD

Example embodiments of the present disclosure relate generally to finishing materials, and, more particularly, to tile alternatives and associated methods of manufacturing.

BACKGROUND

Traditionally, the installation of finishing materials in residential and commercial contexts, such as tiling a kitchen's backsplash or a bathroom's shower surround, requires premium materials in conjunction with skilled labor. The process of installing these materials is often time consuming, tedious in operation, and, as a result, expensive. Additionally, the availability of skilled labor to perform these tasks (e.g., qualified tile setters or the like) has recently diminished resulting in a need for alternative solutions. Any attempt at replacing this traditional approach, however, has resulted in materials that lack the requisite quality and surface finish to accurately replicate both the look and feel of traditional ceramic tiles. Furthermore, conventional methods require increased wait time following installation and special cutting tools to dimension the finishing materials. These methods often result in an uneven surface finish (e.g., lippage) that lacks the aesthetic appeal desired in residential and commercial finishes.

Applicant has identified a number of additional deficiencies and problems associated with conventional finishing materials. Through applied effort, ingenuity, and innovation, many of these identified problems have been solved by developing solutions that are included in embodiments of the present disclosure, many examples of which are described in detail herein.

BRIEF SUMMARY

Accordingly, the apparatuses and methods described herein provide improved mechanisms for providing cost-effective finishing materials that mimic the appearance and feel of traditional tile assemblies and provide improved functionality relating to water-resistance and fire-resistance. As described hereinafter, the apparatuses and methods of the present disclosure provide, in some embodiments, an integrated two-in-one product (i.e., a rough-surface water-resistant backer board and a finished-surface ceramic tile alternative) formed as a solid, single sheet, features not found in traditional finishing materials. In some embodiments, a tile alternative material including a substrate is provided. The substrate may define a first surface and a second surface, where the first surface is opposite the second surface, and the second surface is configured to be secured to a support surface. The tile alternative material may include an exterior layer that is coated on the first surface of the substrate, and a pattern element formed in the first surface of the substrate. The pattern element may define one or more recessed portions of the first surface in which the substrate and exterior layer coated thereon are removed.

In some embodiments, the exterior layer includes an ultraviolet (UV) curable paint, surface coating, or resin and the substrate comprises a magnesium oxide material.

In other embodiments, the second surface may receive an adhesive disposed thereon for securing the tile alternative material to the support surface.

In some cases, the one or more recessed portions may receive a grouting material disposed therein, and the exterior layer may include a water-resistant material.

In some still further embodiments, the tile substrate may include a fire-resistant material and/or a water-resistant material.

A method of manufacturing a tile alternative material is also provided herein. The method may include providing a substrate where the substrate defines a first surface, and a second surface opposite the first surface. The second surface may be configured to be secured to a support surface. The method may further include coating an exterior layer on the first surface of the substrate, and forming a pattern element in the first surface of the substrate. Forming the pattern element may include removing material from the substrate and exterior layer of the first surface to form one or more recessed portions.

In some embodiments, the exterior layer includes an ultraviolet (UV) curable paint, surface coating, or resin and the substrate comprises a magnesium oxide material.

In other embodiments, the second surface may receive an adhesive disposed thereon for securing the tile alternative material to the support surface.

In some cases, the one or more recessed portions may receive a grouting material disposed therein, and the exterior layer may include a water-resistant material.

In some still further embodiments, the tile substrate may include a fire-resistant material.

In some cases, the method may further include, in response to coating an exterior layer on the first surface of the substrate, sanding the first surface of the substrate. In such an embodiment, the method may further include iteratively sanding the first surface of the substrate to achieve a desired finish.

In other embodiments, the method may further include iteratively coating an exterior layer on the first surface of the substrate in order to achieve a desired thickness of the exterior layer.

In some still further embodiments, forming a pattern element in the first surface of the substrate further includes milling the first surface to form one or more recessed portions.

BRIEF DESCRIPTION OF THE DRAWINGS

Figure 1:
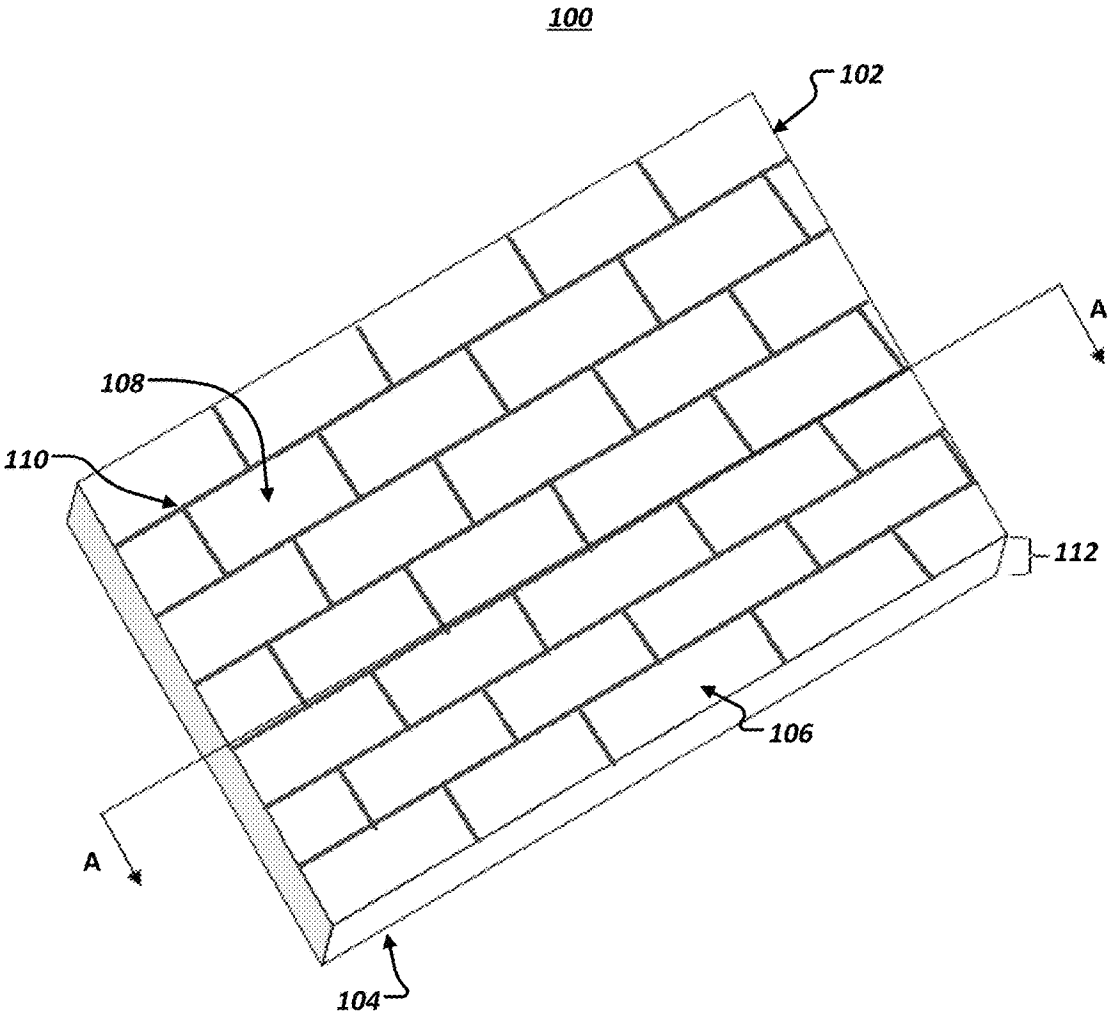

Having thus described the disclosure in general terms, reference will now be made to the accompanying drawings, which are not necessarily drawn to scale, and wherein:

FIG. 1 illustrates a perspective view of a tile alternative material in accordance with some embodiments described herein.

Figure 2:
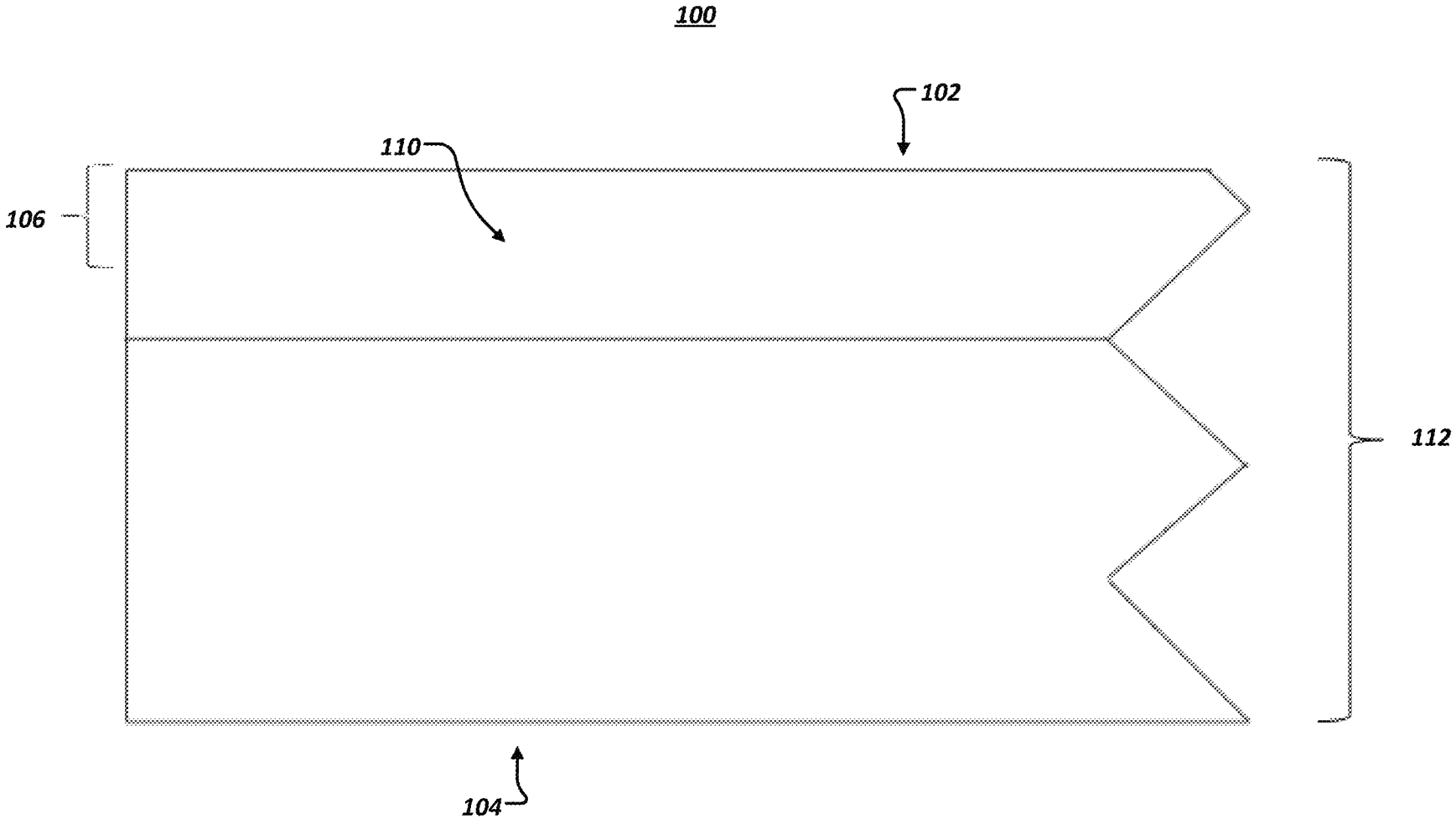

FIG. 2 illustrates a cross-sectional view of the tile alternative material of FIG. 1 along line A-A in accordance with some embodiments described herein.

Figure 3:
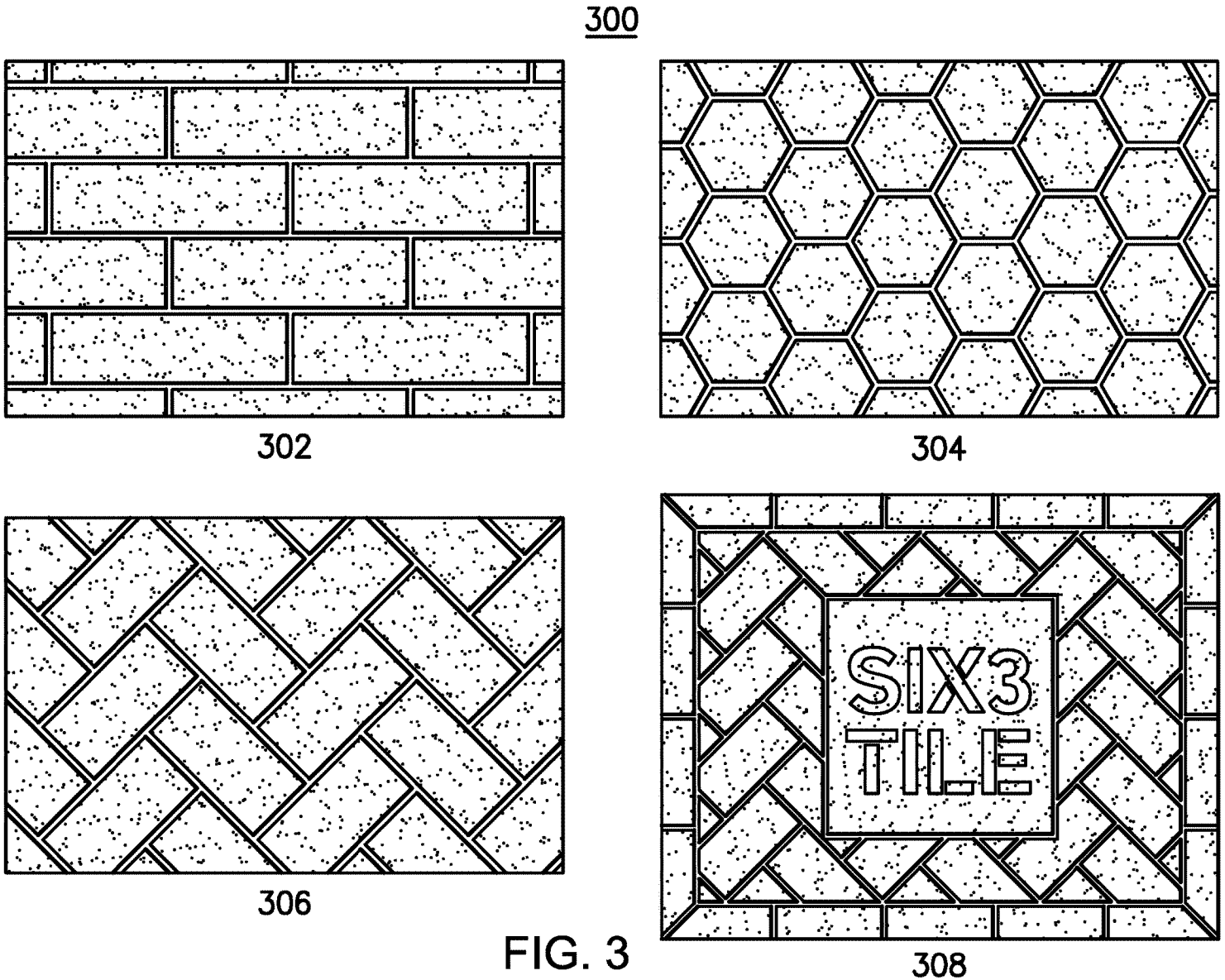

FIG. 3 illustrate tile alternative materials having varying pattern elements in accordance with some embodiments described herein.

Figure 4:
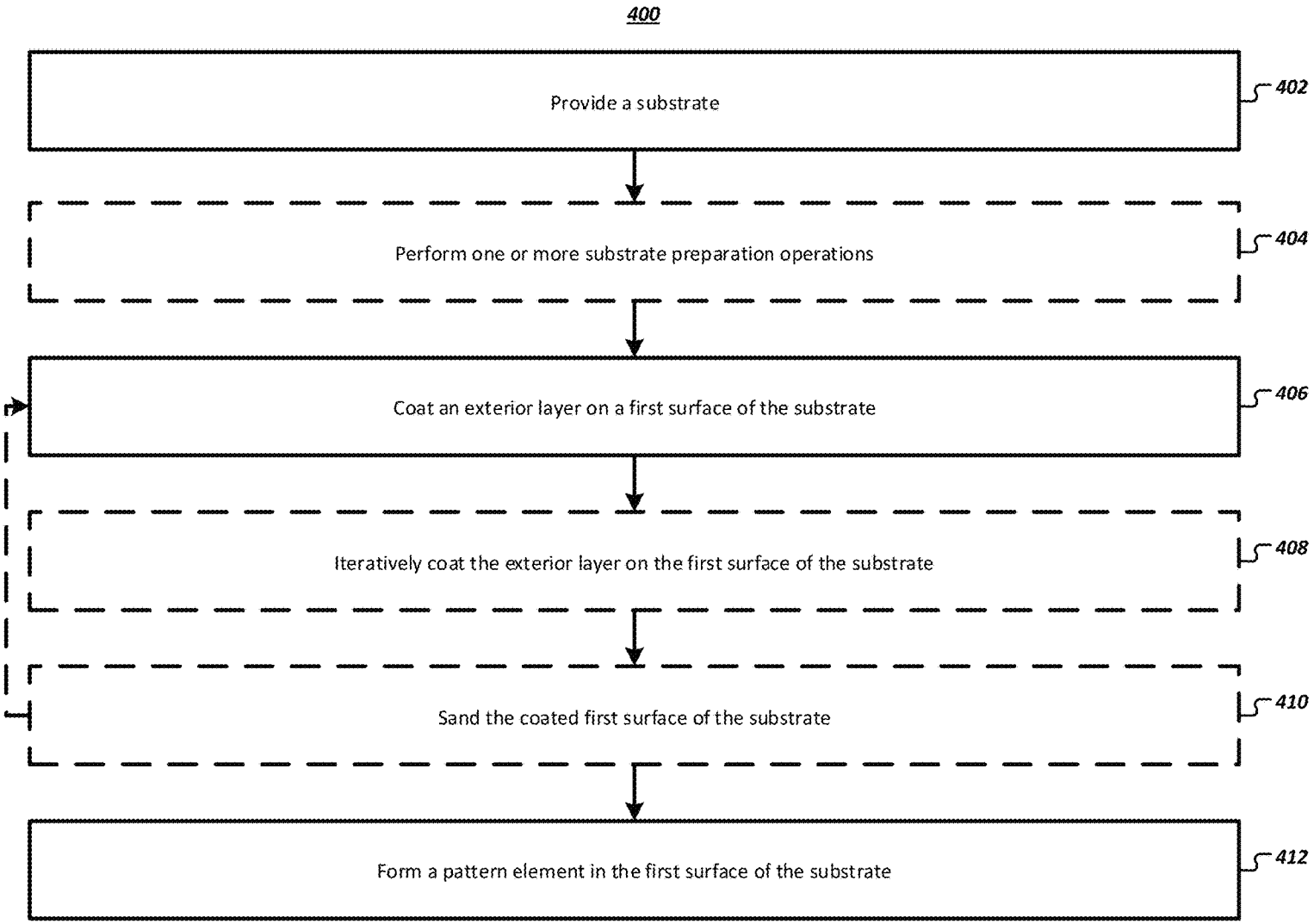

FIG. 4 illustrates a flowchart depicting a method of manufacturing a tile alternative material in accordance with some embodiments described herein.

Figure 5:
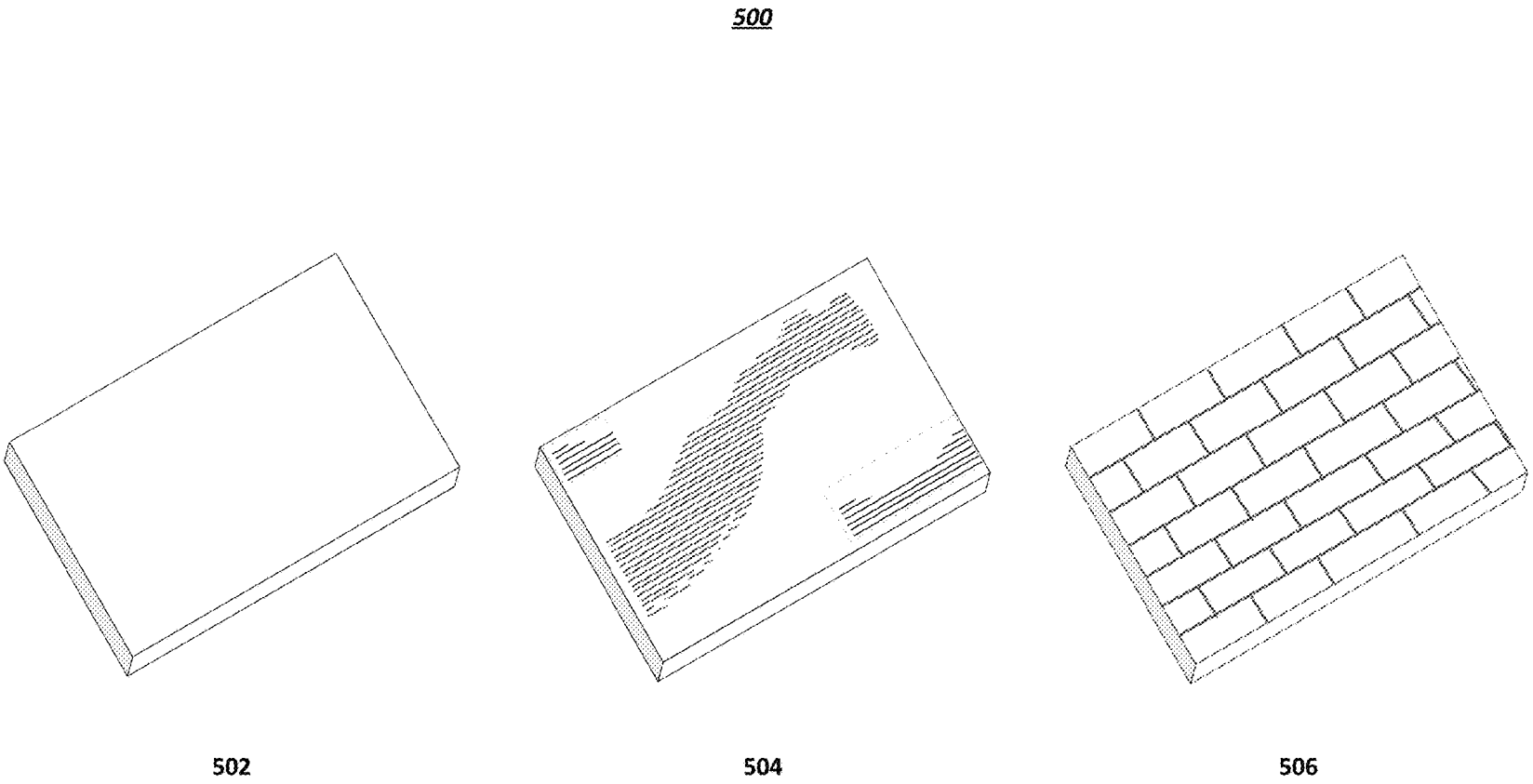

FIG. 5 illustrates stages in the method of manufacturing of FIG. 4 in accordance with some embodiments described herein.

Figure 6:
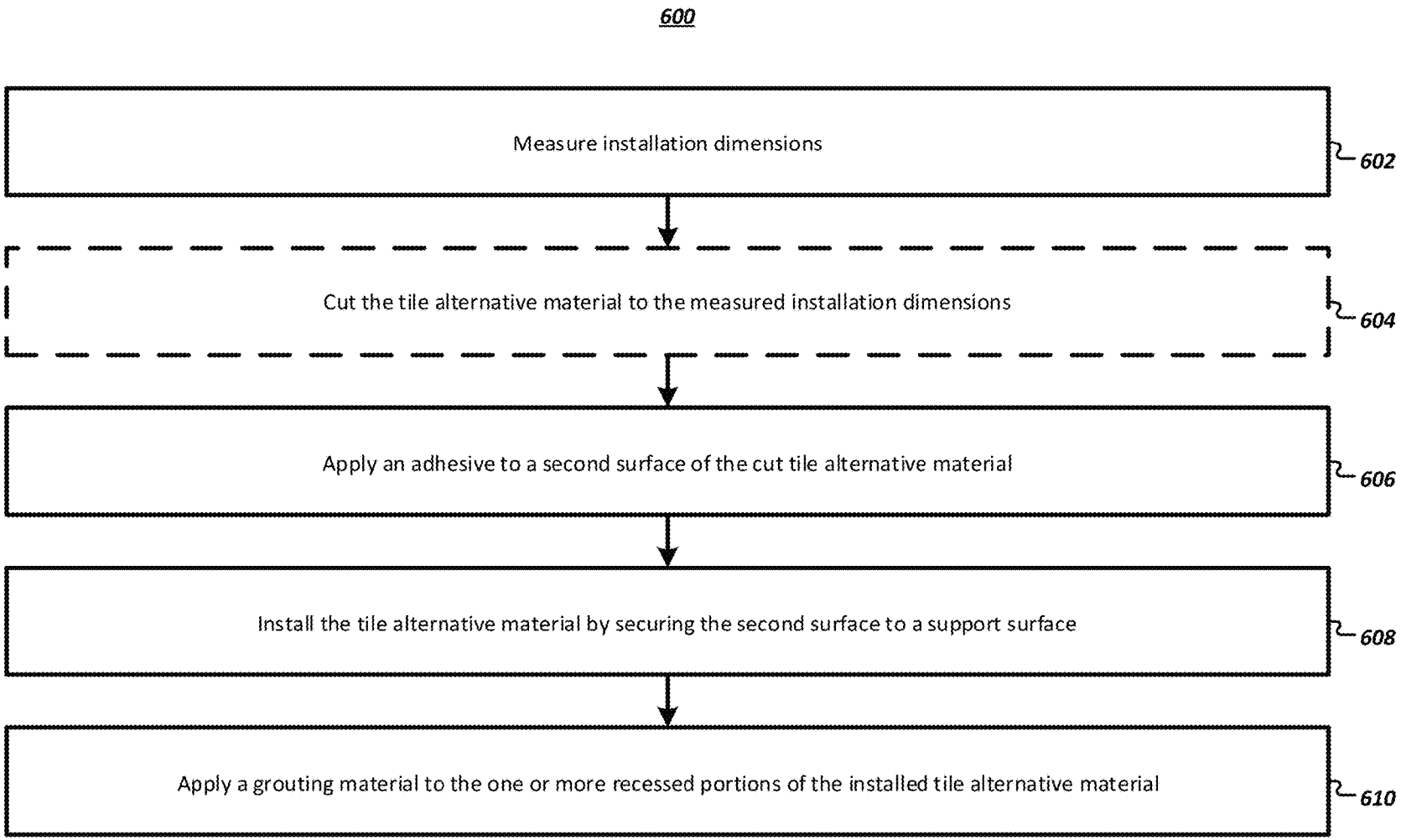

FIG. 6 illustrates a flowchart depicting a method of installation of a tile alternative material in accordance with some embodiment described herein.

DETAILED DESCRIPTION OF THE DRAWINGS

Overview

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout. As used herein, terms such as "front," "rear," "top," etc. are used for explanatory purposes in the examples provided below to describe the relative position of certain components or portions of components.

As used herein, the term "comprising" means including but not limited to, and should be interpreted in the manner it is typically used in the patent context. Use of broader terms such as comprises, includes, and having should be understood to provide support for narrower terms such as consisting of, consisting essentially of, and comprised substantially of.

As used herein, the phrases "in one embodiment," "according to one embodiment," "in some embodiments," and the like generally refers to the fact that the particular feature, structure, or characteristic following the phrase may be included in at least one embodiment of the present disclosure. Thus, the particular feature, structure, or characteristic may be included in more than one embodiment of the present disclosure such that these phrases do not necessarily refer to the same embodiment.

As used herein, the word "example" is used herein to mean "serving as an example, instance, or illustration." Any implementation described herein as "example" is not necessarily to be construed as preferred or advantageous over other implementations.

Tile Alternative Material

With reference to FIG. 1, an example tile alternative material 100 (e.g., "tile board 100") is illustrated. As shown, the tile board 100 may define a first surface 102, a second surface 104, and a thickness 112. As illustrated, the first surface 102 and the second surface 104 may be located opposite one another (e.g., substantially parallel with respect to one another), and, in conjunction with the defined thickness 112, may define a rectangular prism (e.g., sheet, board, or the like). As described above, the tile board 100 may be configured to function as an alternative to traditional tile assemblies in which individual sections of tile are independently secured to a support surface (e.g., wall, backsplash, shower, sink, flooring, etc.). As shown and described further hereinafter, the tile board 100 may be defined as a sheet having a rectangular cross-section such that the tile board 100 may be easily adapted for installation with support surfaces of varying dimensions and configurations.

As described further hereafter with reference to the installation illustrated in FIG. 6, the tile board 100 may define a second surface 104 that is located opposite the first surface 102. As would be evident to one of ordinary skill in the art in light of the present disclosure, the second surface 104 of the tile board may be formed as a rectangular plane configured to be secured to a support structure in order to hang or otherwise install the tile board 100. In some embodiments, the second surface 104 of the tile board 100 may be configured to receive an adhesive (e.g., glue, paste, epoxy, resin, cement, mortar, or the like) for securing the tile board 100 to the support surface. By way of example, the second surface of the tile board 100 may receive a construction grade adhesive disposed thereon in sufficient quantity so as to attach the tile board 100, via the second surface 104, to a kitchen wall (e.g., to serve as a kitchen backsplash). While described herein with reference to a kitchen wall, the second surface 104 may be equally attached or otherwise secured to any number of support structures without limitation.

The second surface 104, and by extension the first surface 102, may furthermore be dimensioned (e.g., sized and shaped) for attachment to any support structure, in whole or in part. Said differently, in some embodiments, the tile board 100 may be sectioned or modified (e.g., cut to form) so as to cover complex geometries (e.g., corners, rounded surfaces, etc.) or to fit particular shapes. For example, the tile board 100 may be cut such that the first surface 102 and the second surface 104 form circular planes (e.g., the tile board 100 is formed as a cylinder) in order to be secured to a circular support surface. Additionally, the thickness 112 of the tile board 100 may similarly be adjusted (e.g., by using fewer coats of an exterior layer as described in FIG. 4 or by providing a thinner substrate) based upon the associated application of the tile board 100. For example, in an instance in which the tile board 100 is secured to a wall that is seldom contacted (e.g., located on a high wall, within a glass case, etc.), the tile board 100 may be configured to define a smaller thickness 112 as compared to instances in which the tile board 100 is secured to a high traffic or contact area (e.g., as flooring, shower wall, etc.).

With continued reference to FIG. 1, the tile board 100 may also define a first surface 102 opposite the second surface 104, and, as described above, the first surface 102 may be configured as an exterior or decorative portion of the tile board 100. In order to mimic or otherwise be indistinguishable from conventional tile assemblies, the first surface 102 of the tile board may be coated with an exterior layer 106. As described hereafter with reference to the method of manufacturing illustrated in FIGS. 4-5, the exterior layer 106 may be iteratively applied to coat the first surface 102 of the tile board 100. In this way, the exterior layer 106 may define a thickness that is dependent upon the number of iterations performed in this coating process. As shown more clearly in the cross-section of FIG. 2, the exterior layer 106 may serve as the outermost layer of the tile board 100 and may, therefore, be comprised of a durable material having a finish similar to that of convention tile assemblies. In some embodiments, the exterior layer 106 may comprises an ultraviolet ("UV") curable paint, resin, surface filler, coating, or the like that, when cured, provides a tactile feel similar to or otherwise indistinguishable from conventional tile materials. In other embodiments, iterative applications of other paints, coatings, epoxies, films, or the like in sufficient quantity may be used on the first surface 102 and allowed to dry (e.g., cure) in order to form the exterior layer 106.

Traditional attempts to provide alternative tile materials often generate materials having various surface deformations (e.g., pinholes, cracks, or the like) that reduce the aesthetic appeal of the product. As described above, the exterior layer 106 of the present disclosure overcomes these obstacles by providing an exterior layer with reduced surface imperfects such that the tile board 100 may be substantially equivalent to convention tile assemblies. Furthermore, the exterior layer 106 of the present disclosure may also include any number of dyes or other finishing features such that the tile board 100 may be adapted to a user's desired aesthetic or application. For example, the exterior layer may include a black dye such that the outwardly facing surface of the tile board 100 may conceal or reduce the appearance of dirt and debris in high-traffic applications.

With continued reference to FIG. 1, the first surface 102 of the tile board 100 may further define a pattern element 108. As described further hereafter with reference to the method of manufacturing illustrated in FIGS. 4-5, the pattern element 108 may be formed in the first surface 102 to provide a decorative exterior or outwardly facing surface of the tile board 100. In particular, the pattern element 108 defines one or more recessed portions 110 of the first surface 102 in which the first surface 102 (e.g., a substrate described below with reference to FIGS. 4-5) and the exterior layer 106 coated thereon are removed. As would be evident to one of ordinary skill in the art in light of the present disclosure, the pattern element 108 may be formed in the first surface 102 of the tile board 100 by removal (e.g., via a milling process) of portions of the first surface 102 and, by extension the exterior layer 106. As illustrated in FIG. 1, the pattern element 108 may include a plurality of recessed portions 110 that resemble grout lines in conventional tile assemblies. In this way, the removed material of the first surface 102 and the exterior layer 106 corresponds to the recessed portions 110 and may define a plurality of rectangular portions that are raised with respect to the recessed portions 110. These resultant rectangular portions defined by the recessed portions 110 may resemble a traditional subway tile aesthetic in which several individual tile sections are assembled to form a panel or backsplash.

With reference to the cross-sectional view of FIG. 2, the formation of the recessed portions 110 to form the pattern element 108 in the first surface 102 is shown. As illustrated, the thickness 112 of the tile board 100 may be removed (e.g., via a milling process or the like) to form the recessed portions 110 where the thickness 112 of the tile board 100 is reduced as compared to the remaining portions (e.g., forming the pattern element 108). Furthermore, as show in FIG. 2, the exterior layer 106 may similarly be removed at the recessed portions 110 such that the top surface 102 is revealed (e.g., not covered by the exterior layer 106). While FIG. 2 illustrates and the present disclosure describes that all of the exterior layer 106 is removed at the recessed portions 110, the present disclosure equally contemplates that, in some embodiments, the exterior layer 106 may also remain in the recessed portions 110. For example, the exterior layer 106 may comprises a thickness value of 5 mm (e.g., generated from iterative coats of the exterior layer 106 to the top surface 102), while the recessed portion defines a depth of only 4 mm. In this way, the exterior layer 106 comprises a remaining thickness value of 1 mm in the recessed portions 110. Furthermore, in some embodiments, the exterior layer 106 may be applied after the pattern element 108 is formed such that the recessed portions 110 are also coated with the exterior layer 106.

With reference to FIG. 3, various pattern elements 108 are illustrated according to example embodiments of the present disclosure. As illustrated, pattern element 302 corresponds to a subway tile configuration, pattern element 304 corresponds to a honeycomb/hexagonal configuration, pattern element 306 corresponds to a herringbone configuration, and pattern element 308 corresponds to a custom configuration. Although illustrated in FIG. 3 with particular example pattern elements 108, the present disclosure contemplates that any design, feature, shape, or the like may be defines by the first surface 102 as the pattern element 108. For example, an emblem, logo, or other related identifier may be defined as the pattern element 108 such that the tile board 100 may function as a sign, billboard, illustration, or the like (e.g., pattern element 308).

Example Method of Manufacture

With reference to FIGS. 4-5, a method of manufacturing a tile alternative material (e.g., tile board 100) is illustrated. As shown, the method of manufacture (e.g., method 400) may include providing a substrate at Block 402 (e.g., substrate 502 in FIG. 5). As illustrated above in FIGS. 1-2, the substrate may correspond to the tile board 100 (e.g., the first surface 102, the second surface 104, and the thickness 112) prior to application of the exterior layer 106. In some embodiments, the substrate may comprise a magnesium oxide ("MgO") material (e.g., or associated composites substantially comprised of magnesium oxide). In such an embodiment, the MgO substrate may operate to improve the water-resistance and fire-resistance of the resultant tile alternative material (e.g., tile board 100). By utilizing a MgO substrate, the tile board 100 created by the method illustrated in FIGS. 4-5 may be used not only as a backsplash in kitchen or other relatively dry embodiments, but may further be used to enclosed and cover showers, bathrooms, vanities, and the like in which moisture is expected. Still further, the embodiments of the present application may be equally applicable to tub surrounds, wainscoting, flooring, ceiling, or any other related interior or exterior application without limitation.

The method 400 may, in some alternative or additional embodiments, include performing one or more substrate preparation operations at Block 404. As would be evident to one of ordinary skill in the art in light of the present disclosure, the substrate provided at Block 402 may be in a raw form. In this way, the condition of the substrate may, in some embodiments, inhibit the steps performed at Blocks 406-412. For example, the raw substrate provided at Block 402 may include debris resulting from the manufacturing of the substrate. This debris may inhibit the coating of the exterior layer at Block 406 hereafter or may result in an exterior layer of varying thickness across the substrate. In order to prevent any subsequent error in the method 400, in some embodiments, the method may include performing one or more substrate preparation operations at Block 404 to place the substrate in proper condition for the subsequent method steps. For example, the method 400 may include clearing the substrate of debris, an initial sanding of the first surface and the second surface (e.g., first surface 102 and second surface 104 in FIGS. 1-2, respectively), or the like at Block 404. In other embodiments, the dimensions (e.g., size and shape) of the substrate provided at Block 402 may be too large. In such an embodiment, the substrate may be cut (e.g., split, quartered, or the like) in order to properly dimension the substrate for subsequent method steps described herein.

The method 400 may further include coating an exterior layer on a first surface of the substrate at Block 406 (e.g., coated substrate 504 in FIG. 5). As described above with reference to FIGS. 1-2, an exterior layer 106 (e.g., a UV curable paint or resin) may be coated or otherwise applied to the first surface of the substrate. In some embodiments, various conveyor systems may be utilized by the method 400 to transport the substrate during the coating process. For example, in some embodiments, the coating of the exterior layer (e.g., exterior layer 106 in FIGS. 1-2) may be performed by a roll coater such that one or more conveyor systems pass the substrate substantially perpendicular with respect to the application flow of the exterior layer 106. In this way, as the substrate passes beneath the roll coater, via the one or more conveyor assemblies, the substrate is coated across the first surface of the substrate.

As the substrate is carried by the one or more conveyor assemblies, in some embodiments, a UV curing system (e.g., an array of ultra-violet lights) may be disposed along one or more of the conveyor assemblies. In this way, the UV paint or resin (e.g., exterior layer 106) may be substantially hardened for receiving subsequent steps of the method 400.

In some embodiments, the method 400 may include iteratively coating the exterior layer on the first surface of the substrate at Block 408. In coating the first surface of the substrate at Block 406, in some embodiments to reduce the required physical footprint of the conveyor systems, only a portion of the required exterior layer may be applied to the substrate. As would be evident to one of ordinary skill in the art in light of the present disclosure, the curing process of a UV paint or resin requires exposure time to a UV curing system that, in a single coating step at Block 406, would require a significant length of conveyor assemblies. As such, for practical purposes, some embodiments described herein may iteratively perform the coating steps at Block 406 in order to achieve a desired thickness of the exterior layer. While reference herein is made to a roll coater application, the present disclosure contemplates than any other means for coating the first surface of the substrate with the exterior layer (e.g., dipping the substrate, spraying the substrate, or the like) or machinery (e.g., curtain coater or the like) may be utilized by the method 400.

The method 400 may further include sanding the coated first surface of the substrate at Block 410 (e.g., via a palm sander or any other sanding means known in the art). The application of the exterior layer on the first surface of the substrate at Blocks 406-408 ideally results in an exterior layer having a uniform thickness and finish. In practice, however, some embodiments of the method 400 may utilize one or more sanding steps at Block 410 in order to remove surface imperfections associated with the exterior layer. In this way, the coated substrate (e.g., coated substrate 504 in FIG. 5) may resemble a single conventional tile (e.g., prior to forming a desired pattern at Block 412). In some embodiments, following sanding the coated first surface of the substrate at Block 410, the coated substrate may be subjected to one or more additional coats of the exterior layer at Blocks 406-408. For example, in some embodiments, the condition of the resultant exterior layer at Block 410 may be unsatisfactory (e.g., an exterior layer lacking sufficient thickness). To correct the substrate and exterior layer, the method 400 may perform the steps illustrated at Blocks 406-410 until the desired thickness, finish quality, or the like is achieved. By way of example, various iterations of the sanding step illustrated at Block 410 may be performed with incrementally increasing sanding fineness or grit (e.g., a first sanding operation with 120 grit sandpaper and a final sanding operation with 400 grit sandpaper) in order to achieve a desired surface finish.

The method may include forming a pattern element in the first surface of the substrate at Block 412 (e.g., tile board 506 in FIG. 5). As described above, the pattern element of the first surface may be defined by one or more recessed portions (e.g., pattern element 108 defined by recessed portions 110 in FIGS. 1-2) in which material from the substrate and the exterior layer coated thereon is removed. For example, in some embodiments, the coated substrate may be secured within a computer numeric control (CNC) machine that is configured to form one of more pattern elements in the first surface of the coated substrate. For example, the CNC machine may receive instructions to create a pattern element that resembles a traditional subway tile aesthetic. The CNC machine may select the appropriate tooling for preforming this operation and may mill or otherwise machine this design in the first surface of the substrate. Said differently, the CNC machine may mill the first surface to create the one or more recessed portions defining the pattern element by removed material from the coated substrate. While description herein is provided for a milling process to form the pattern element, the present disclosure contemplates that any operation for removing material from the first surface of the coated substrate (e.g., cutting, machining, or the like) may also be used. In this way, the present disclosure creates a pattern element not found in traditional finishing materials. Said differently, forming the pattern element via a removal of material from the first surface of the coated substrate stands in stark contrast to traditional tile installation (e.g., installation and grouting of individual tiles) and conventional alternatives (e.g., poured molds, pressure molding, printing, stamping, film application, or any combination thereof).

As would be evident to one of ordinary skill in the art in light of the present disclosure, following the method 400 illustrated in FIGS. 4-5, various quality control operations (e.g., cleaning, surface treatment, or the like) may be performed on the tile alternative material (e.g., tile board 605) to place the material in proper condition for use. By way of example, forming the pattern element in the first surface of the substrate at Block 412 may result in remaining dirt, debris, chips, and/or swarf deposits on the first surface of the substrate. In order to ensure a proper surface finish, the methods described herein may utilize a board burning sequence in which a torch or other flame source is applied to the patterned first surface in order to remove said dirt, debris, chips, and/or swarf deposits. In some embodiments, the method may further include a vacuuming and/or air cleaning sequence in which the first surface receives a vacuum source or pressurized air source (e.g., an air knife) in order to ensure the first surface is adequately cleaned. As described above, the patterned substrate (e.g., tile board 506 in FIG. 5) may be subsequently painted based upon a desired aesthetic appeal.

Moreover, the steps in the method described above may not necessarily occur in the order depicted in FIGS. 4-5, and in some cases one or more of the steps depicted may occur substantially simultaneously, or additional steps may be involved. Although specific terms are employed herein, they are used in a generic and descriptive sense only and not for purposes of limitation. For example, in some alternative embodiments, forming the pattern at Block 412 may occur prior to coating the substrate at Blocks 406-408. In this way, the recessed portions of the substrate may also be coated in the exterior layer at Blocks 406-408.

Example Method of Installation

With reference to FIG. 6, an example method of installation (e.g., method 600) of the alternative tile material (e.g., tile board 100) is illustrated. The method may include measuring installation dimensions at Block 602 and, as necessary, cutting the tile alternative material to the measured installation dimensions at Block 604. As is evident by the description herein, the tile alternative material (e.g., tile board 100) may be formed in thin rectangular sheets. During installation of these sheets, the tile board may be cut or otherwise modified in size to fit a desired installation dimension.

The method 600 may further include applying an adhesive to a second surface of the cut tile alternative material at Block 606 and installing the tile alternative material by securing the second surface to a corresponding support surface at Block 608. As described above with reference to FIGS. 1-2, the second surface of the tile alternative material (e.g., tile board 100) may be configured to be secured to a support surface. In some embodiments, an adhesive is applied to the second surface in sufficient quantity as to secure the tile board to a wall or other support surface. The installation of the tile alternative material at Block 608 may further include positioning of subsequent tile boards adjacent to one another so as to create the appearance of a continuous tiled panel. For example, in some embodiments, the tile board may, at opposing ends of the tile board, include feathered pattern elements (e.g., subway tiles) such that the abutting tile boards may nest. In this way, the installed tile board may appear uniform and substantially equivalent to traditionally installed single tile assemblies. While description above is provided with reference to an adhesive, the present disclosure contemplates that any attachments means (e.g., loop and hook, male to female connectors, fasteners, crown staples, or the like) may also be used.

The method 600 may further include applying a grouting material to the one or more recessed portions of the installed tile alternative material (e.g., tile board 100) at Block 610. In order to achieve the desired aesthetic appearance in conjunction with the water-resistance (e.g., required by some applications such as enclosing a shower), a grouting material may be used to fill the recessed portions of the tile board. In this way, the tile alternative material functions similar to traditional tile assemblies by providing an aesthetically pleasing, water-resistant, wall covering. Said differently, the installed and grouted tile alternative material of the present disclosure is substantially indistinguishable from individually installed tiles, a feature not found in conventional alternative. With regard to the present invention, however, these features are further achieved at a reduced cost, an increased ease of installation, and improved fire-resistance (e.g., when using an MgO substrate). Furthermore, the tile alternative materials of the present application may also be easily repaired following installation. For example, individual and/or multiple tiles may be removed following installation and replaced without delay (e.g., due to grouting drying time), a feature not found in traditional methods.

Many modifications and other embodiments of the inventions set forth herein will come to mind to one skilled in the art to which these inventions pertain having the benefit of teachings presented in the foregoing descriptions and the associated drawings. Although the figures only show certain components of the apparatus and systems described herein, it is understood that various other components may be used in conjunction with the tile alternative material. Therefore, it is to be understood that the inventions are not to be limited to the specific embodiments disclosed and that modifications and other embodiments are intended to be included within the scope of the appended claims. Moreover, the steps in the method described above may not necessarily occur in the order depicted in FIGS. 4-6, and in some cases one or more of the steps depicted may occur substantially simultaneously, or additional steps may be involved. Although specific terms are employed herein, they are used in a generic and descriptive sense only and not for purposes of limitation.

What is claimed is:

1. A tile alternative material comprising:

a substrate defining a first surface and a second surface, wherein the first surface is opposite the second surface, and the second surface is configured to be secured to a support surface;

an exterior layer coated on the first surface of the substrate; and a pattern element formed in the first surface of the substrate, wherein the pattern element is defined by one or more recessed portions disposed into the first surface of the substrate partially through the substrate where the substrate and exterior layer coated thereon are removed.

2. The tile alternative material according to claim 1, wherein said exterior layer comprises at least one of an ultraviolet (UV) curable paint, a surface coating, or a resin.

3. The tile alternative material according to claim 1, wherein said substrate comprises a magnesium oxide material.

4. The tile alternative material according to claim 1, wherein said second surface is configured to receive an adhesive disposed thereon for securing the tile alternative material to said support surface.

5. The tile alternative material according to claim 1, wherein said one or more recessed portions are configured to receive a grouting material disposed therein.

6. The tile alternative material according to claim 1, wherein said exterior layer comprises a water-resistant material.

7. The tile alternative material according to claim 1, wherein said substrate comprises at least one of a fire-resistant material or a water-resistant material.

8. A method of manufacturing a tile alternative material, the method comprising:

providing a substrate, wherein the substrate defines:

a first surface, and a second surface opposite the first surface, wherein second surface is configured to be secured to a support surface;

coating an exterior layer on the first surface of the substrate; and forming a pattern element in the first surface of the substrate, wherein forming the pattern element comprises removing material from the substrate and exterior layer of the first surface to form one or more recessed portions partially through the substrate.

9. The method according to claim 8, wherein the exterior layer comprises at least one of an ultraviolet (UV) curable paint, a surface coating, or a resin.

10. The method according to claim 8, wherein the substrate comprises a magnesium oxide material.

11. The method according to claim 8, further comprising applying an adhesive to the second surface of the substrate for securing the second surface of the substrate to the support surface.

12. The method according to claim 8, further comprising applying a grouting material to the one or more recessed portions in the first surface.

13. The method according to claim 8, wherein the exterior layer comprises a water-resistant material.

14. The method according to claim 8, wherein the substrate comprises at least one of a fire-resistant material or water-resistant material.

15. The method according to claim 8, further comprising, in response to coating an exterior layer on the first surface of the substrate, sanding the first surface of the substrate.

16. The method according to claim 15, further comprising iteratively sanding the first surface of the substrate to achieve a desired finish.

17. The method according to claim 8, further comprising iteratively coating an exterior layer on the first surface of the substrate in order to achieve a desired thickness of the exterior layer.

18. The method according to claim 8, wherein forming a pattern element in the first surface of the substrate further comprises milling the first surface to form one or more recessed portions.

* * * * *